US007997871B2

(12) United States Patent
Hwang et al.

(10) Patent No.: US 7,997,871 B2
(45) Date of Patent: Aug. 16, 2011

(54) IMPELLER FOR A COOLING FAN

(75) Inventors: Ching-Bai Hwang, Taipei Hsien (TW); Jie Zhang, Shenzhen (CN); Ran Lin, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 943 days.

(21) Appl. No.: 11/940,928

(22) Filed: Nov. 15, 2007

(65) Prior Publication Data

US 2009/0035126 A1 Feb. 5, 2009

(30) Foreign Application Priority Data

Aug. 3, 2007 (CN) ..... 2007 1 0075536

(51) Int. Cl.
*F01D 5/16* (2006.01)

(52) U.S. Cl. ..... 416/175; 416/203; 416/228

(58) Field of Classification Search ..... 416/175, 416/198 R, 200 R, 210 R, 201 A, 203, 228, 416/223 R See application file for complete search history.

(56) References Cited

U.S. PATENT DOCUMENTS

| | | | | |
|---|---|---|---|---|
| 1,916,192 | A * | 7/1933 | Anctil | 416/203 |
| 1,946,571 | A * | 2/1934 | Briner | 416/175 |
| 2,083,996 | A * | 6/1937 | Jonn | 416/203 |
| 3,536,417 | A * | 10/1970 | Merkle et al. | 416/223 R |
| 6,572,336 | B2 * | 6/2003 | Horng et al. | 416/203 |
| 7,008,180 | B2 * | 3/2006 | Fujimori et al. | 415/121.2 |
| D532,903 | S * | 11/2006 | Hirata et al. | D23/413 |
| 7,182,572 | B2 * | 2/2007 | Yang | 415/175 |
| D563,544 | S * | 3/2008 | Hwang et al. | D23/413 |
| 2005/0095132 | A1 | 5/2005 | Kao et al. | |
| 2005/0260073 | A1 | 11/2005 | Hsu et al. | |

FOREIGN PATENT DOCUMENTS

| | | | |
|---|---|---|---|
| CN | 2508028 | Y | 8/2002 |
| FR | 2811158 | A1 | 1/2002 |
| TW | 549484 | A | 8/2003 |
| TW | 1281375 | A | 5/2007 |

* cited by examiner

*Primary Examiner* — Igor Kershteyn
(74) *Attorney, Agent, or Firm* — Jeffrey T. Knapp

(57) ABSTRACT

An impeller (10) for a cooling fan includes a hub (20) having a circular wall (22) and an annular sidewall (24) extending downwardly from a rim of the circular wall, and a plurality of blades (30) extending radially from the sidewall of the hub. Each of the blades includes a first portion (32) near the hub and a second portion (34) away from the hub, wherein each of the first portions is identical to an adjacent one of the first portions, and each of the second portions is different from an adjacent one of the second portions regarding a height thereof, thereby reducing a noise level of the impeller when the it operates.

15 Claims, 7 Drawing Sheets

IMPELLER FOR A COOLING FAN

BACKGROUND OF THE INVENTION

1. Field of the Invention

The present invention relates to an impeller, and more particularly to an impeller for a cooling fan, wherein blades of the impeller have different configurations.

2. Description of Related Art

With continuing development of the electronic technology, electronic components such as CPUs generate more and more heat that is required to be dissipated immediately.

Conventionally, a fan is used to produce an airflow that can remove heat from the electronic component. The fan comprises a stator and a rotor being rotatable with respective to the stator. The rotor further comprises a hub and a plurality of blades extending radially from the hub. In use, the blades of the rotor rotate around the stator to engender the airflow towards the electronic component, thus cooling the electronic component continuously.

Increasing a revolving speed of the fan blades relatively increases the amount of airflow; therefore, a heat dissipation efficiency is relatively improved. However, increasing the revolving speed may cause a noise level of the fan to raise correspondingly, thus making an operator near the fan feel uncomfortable.

What is needed, therefore, is an impeller for a fan which can overcome the above-mentioned disadvantage.

SUMMARY OF THE INVENTION

An impeller for a cooling fan includes a hub having a circular wall and an annular wall extending downwardly from a rim of the circular wall, and a plurality of blades extending radially from the annular wall of the hub. Each of the blades includes a first portion near the hub and a second portion away from the hub, wherein each of the first portions is identical to an adjacent one of the first portions, and each of the second portions is different from an adjacent one of the second portions with a different height, thereby reducing a noise level of the impeller when it rotates.

Other advantages and novel features of the present invention will become more apparent from the following detailed description when taken in conjunction with the accompanying drawings, in which:

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION OF THE INVENTION

Figure 1:
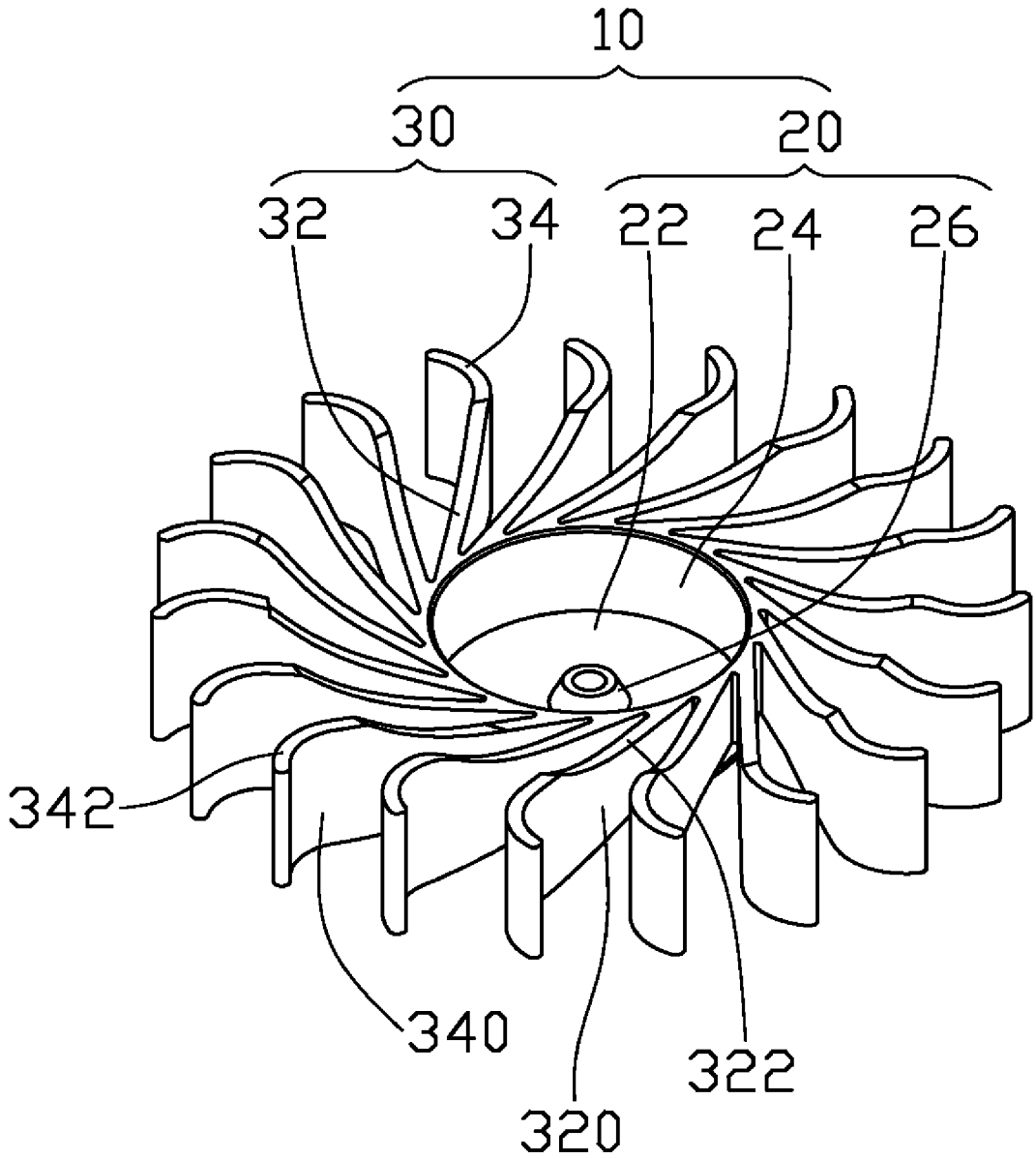
FIG. 1 is an isometric view of an impeller for an electric fan in accordance with a preferred embodiment of the present invention.

Referring to FIG. 1, an impeller 10 for a cooling fan (not shown) of a preferred embodiment of the present invention comprises a hub 20 and a plurality of blades 30 extending radially from a periphery of the hub 20. The impeller 10 in the shown preferred embodiment is for a centrifugal fan (blower).

The hub 20 comprises a circular wall 22 and an annular sidewall 24 extending upwardly and perpendicularly from a rim of the circular wall 22 in a manner that a cylindrical space (not labeled) is defined between the circular wall 22 and the sidewall 24. The circular wall 22 is flat. A protrusion 26 projects upwardly from a central area of a top face of the circular wall 22, wherein a cross-sectional area of the protrusion 26 gradually decreases along an upward direction. Thus, the protrusion 26 forms a tapered configuration. A hole (not labeled) is defined at a top face of the protrusion 26 to engage with a shaft (not shown), thus allowing the hub 20 to perform a rotation in respective to a bearing (not shown) in which the shaft extends.

The blades 30 extend radially and outwardly from the sidewall 24 of the hub 20. The blades 30 are arranged on the hub 20 in balance for preventing the impeller 10 from rotating unstably. Each of the blades 30 comprises a first portion 32 located close to the hub 20, and a second portion 34 located far away from the hub 20, in comparison with the first portion 32. Every two neighboring first portions 32 of the blades 30 are identical to each other, and every two neighboring second portions 34 of the blades 30 are different from each other. Each of the first portions 32 of the blades 30 has a top face 322 coupling with a top surface (not labeled) of the sidewall 24 of the hub 20, a bottom face 324 (shown in FIG. 3) attached to an outer surface of the sidewall 24 of the hub 20, and a pair of opposite lateral faces 320 connecting the outer surface (not labeled) of the sidewall 24 of the hub 20 and between the top face 322 and the bottom face 324. The pair of opposite lateral faces 320 are approximately planar surfaces and parallel to each other, and the bottom face 324 and the top face are concave surfaces and recessed toward each other. A distance between two adjacent first portions 32 increases outwardly to define an acute angle therebetween.

The second portion 34 is curved from an end of the first portion 32 along a counterclockwise direction as viewed from FIG. 1. The second portion 34 has a top face 342 extending from the top face 322 of the first portion 32, a bottom face 344 coupling with the bottom face 324 of the first portion 32, and a pair of opposite lateral faces 340 extending from the pair of opposite lateral faces 320 of the first portion 32, respectively. The top face 342 and the bottom face 344 are parallel to the circular wall 22 of the hub 20, and the pair of opposite lateral faces 340 coupled with each other via a curved end face (not labeled), which is located at a free end of the second portion 34.

Figure 2:
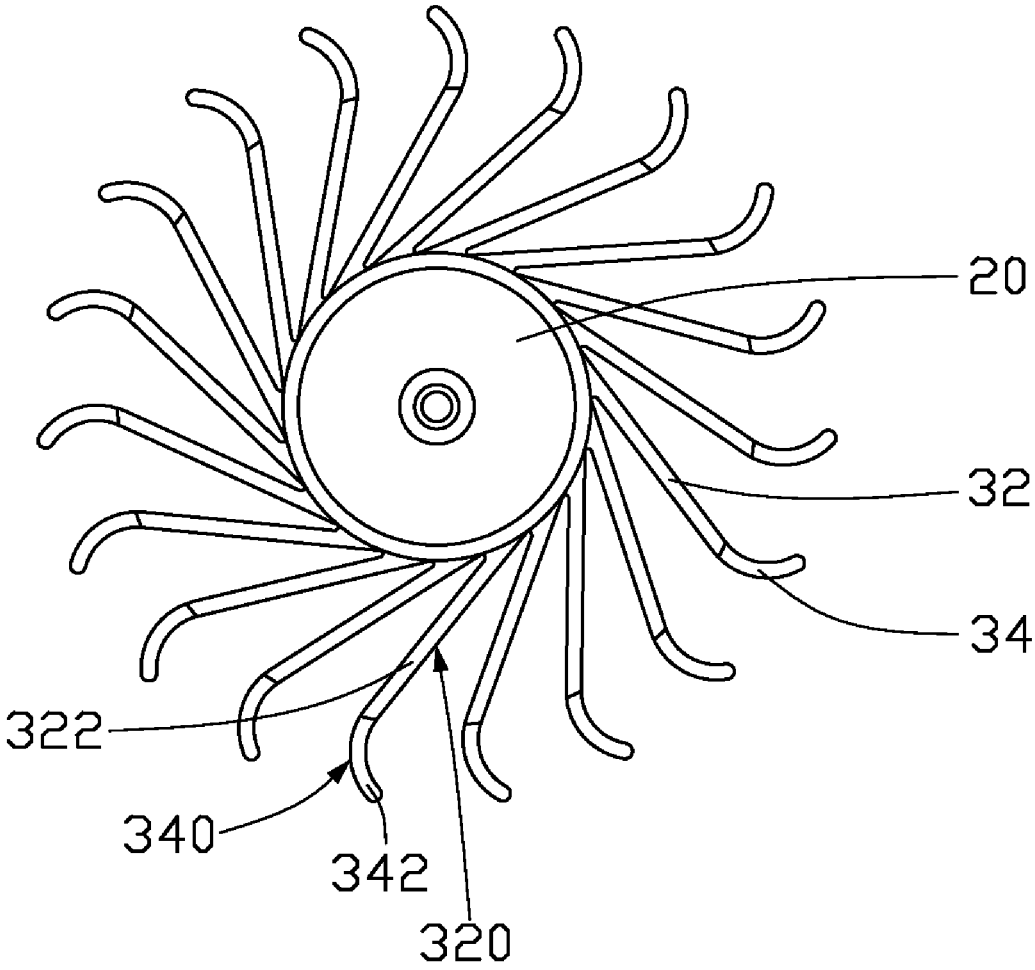
FIG. 2 is a front view of FIG. 1.

Referring to FIG. 2, one of the pair of lateral faces 340 is a concave surface, which connects with a corresponding one of the opposite lateral faces 320 of the first portion 32 to cooperatively act as a windward side; another one of the pair of lateral faces 340 is a convex surface, which cooperates with another one of the opposite lateral faces 320 of the first portion 32 to function as a leeward side. The pair of opposite lateral faces 340 are concentric with each other and tangent to the pair of opposite faces 320 of the first portion 32, respectively.

Figure 3:
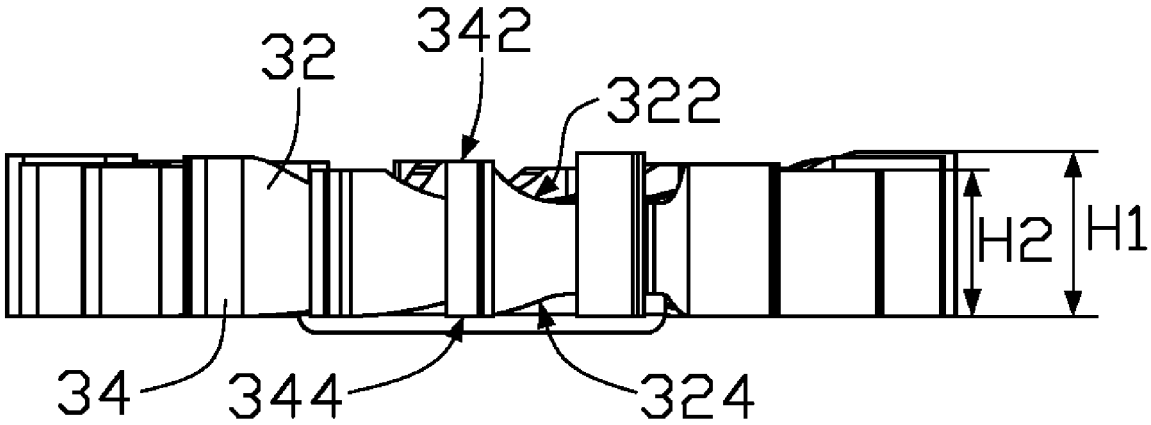
FIG. 3 is a side view of FIG. 1.
Figure 4:
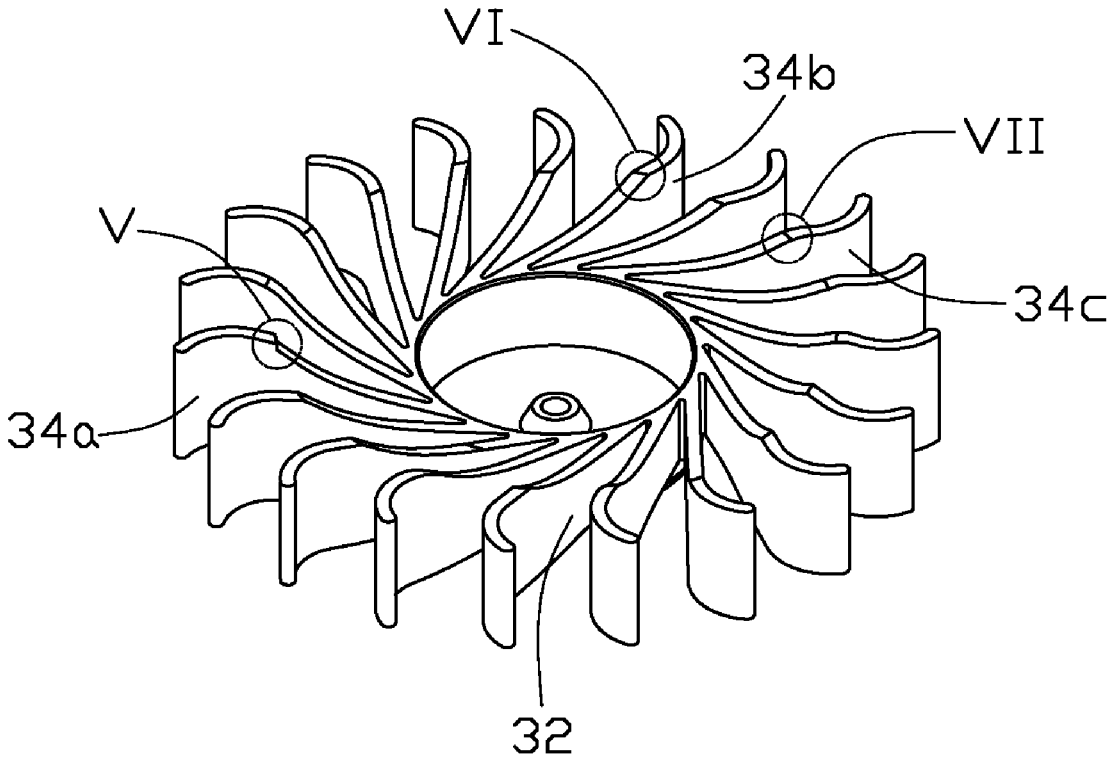
FIG. 4 is a view similar to FIG. 1, with different parts of the impeller being marked.
Figure 5:
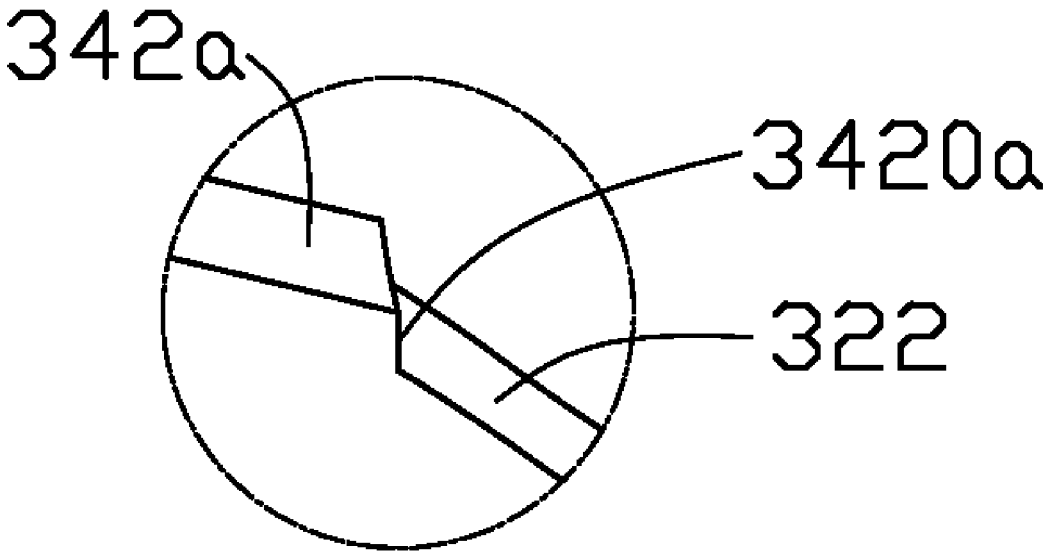
FIG. 5 is an enlarged view of a circled part V of FIG. 4.
Figure 6:
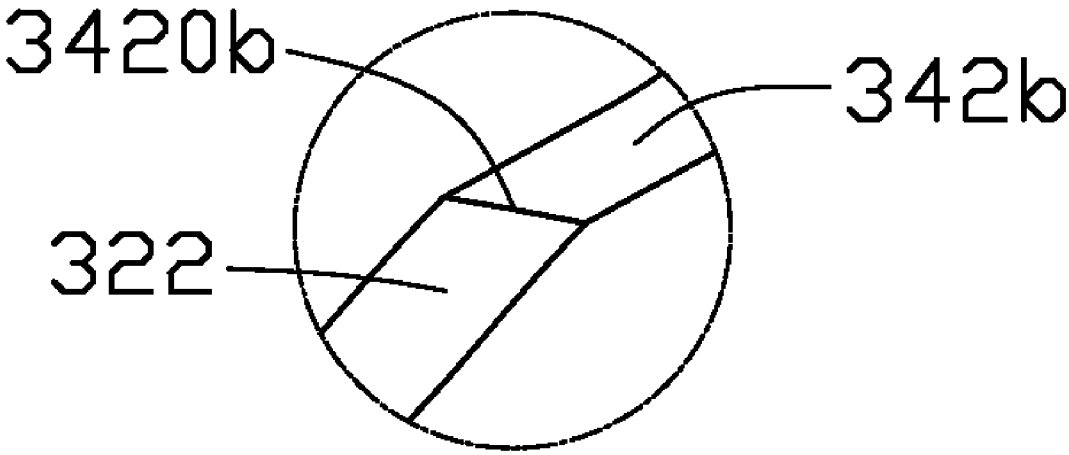
FIG. 6 is an enlarged view of a circled part VI of FIG. 4.
Figure 7:
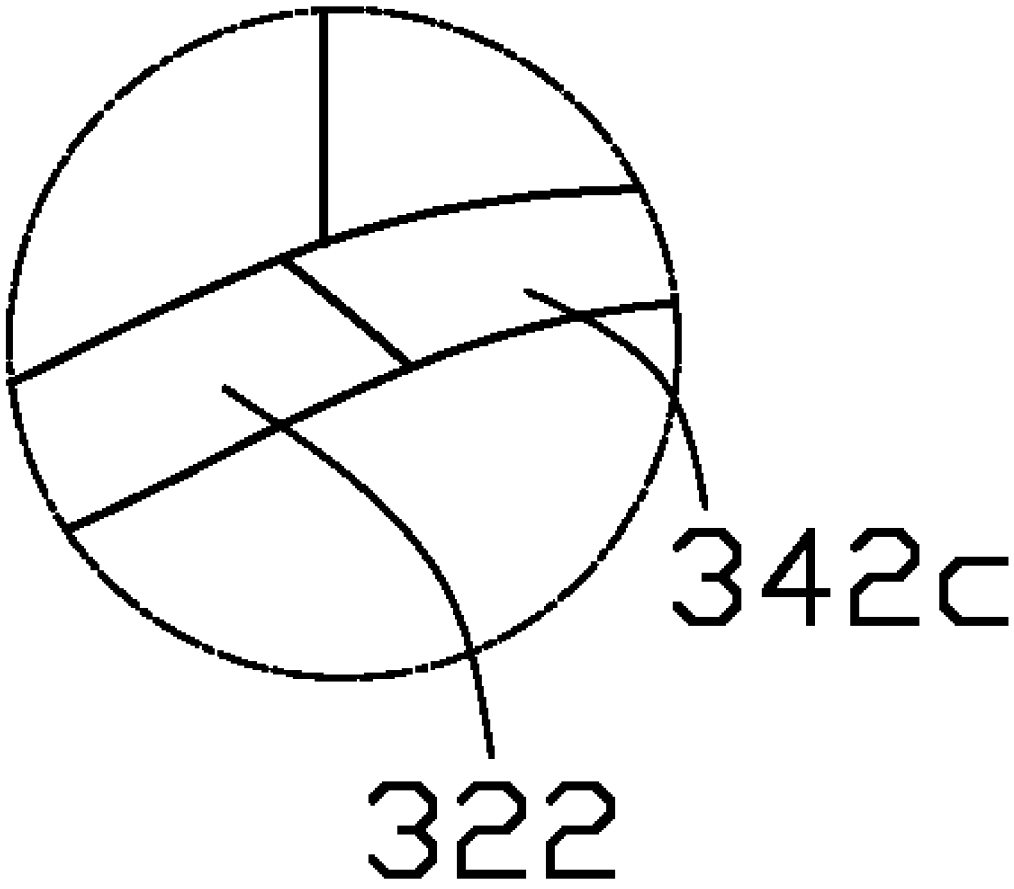
FIG. 7 is an enlarged view of a circled part VII of FIG. 4.

As shown in FIG. 3, the bottom faces 344 of the second portions 34 of the blades 30 are coplanar with each other. A distance (H1) from the top face 342 to the bottom face 344 of each of the second portions 34 is different from a distance (H2) from the top face 342 to the bottom face 344 of an adjacent one of the second portions 34, whereby two adjacent second portions 34 have different heights. Referring to FIGS. 4-7, according to the different heights, the second potions 34 can be approximately divided as three types: first type of second portions 34*a* with top faces 342*a*, second type of second portions 34*b* with top faces 342*b* and third type of second portions 34*c* with top faces 342*c*. For the first type of second portions 34*a*, the top faces 342*a* thereof are spaced from corresponding top faces 322 of the first portions top 32, to form steps 3420*a* therebetween. For the second type of second portions 34*b*, junctions 3420*b* each having a shape like a rigid are formed between the top faces 342*b* and corresponding top faces 322 of the first portions 32. For the third type of second portions 34*c*, top faces 342*c* thereof are directly extended from corresponding top faces 322 of the first portions 32.

In a performance analysis of the cooling fan with the impeller 10 of the present invention, under the same condition of air pressure and air flow rate, a noise level of the fan with the impeller 10 is apparently lower than that of a conventional fan (not shown), due to the second portions 34 of the blades 30 of the impeller 10 having different heights. The first type of the second portions 34*a* is higher than the second type of the second portions 34*b*, which in turn is higher than the third type of the second portions 34*c*. As a result, the noise level in the present invention can be greatly reduced by the different heights of the blades 30. The geometric arrangement that the second portions 34 of the blades 30 of the impeller 10 have different heights is able to lower the amplitude of the harmonic wave of the sound generated by the rotation of the impeller 10, thereby reducing the noise level.

It is believed that the present invention and its advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An impeller adapted for being used in a cooling fan, the impeller comprising:

a hub comprising a circular wall and an annular sidewall extending upwardly from a rim of the circular wall; and a plurality of blades extending radially and outwardly from the annular sidewall of the hub, each of the blades comprising a first portion connecting to the annular sidewall of the hub, and a second portion curved outwardly from the first portion, and each of the blades having a height different from that of an adjacent one of the blades for reducing a noise level when the impeller rotates.

2. The impeller as claimed in claim 1, wherein each of the first portions of the blades has a top face coupling with a top surface of the annular sidewall of the hub, a pair of opposite lateral faces connecting an outer surface of the annular sidewall of the hub, and a bottom face attached to the outer surface of the annular sidewall of the hub.

3. The impeller as claimed in claim 2, wherein the top face and the bottom face of the each of the first portions are concaved towards each other, and the pair of opposite lateral faces of the each of the first portions are parallel to each other.

4. The impeller as claimed in claim 2, wherein each of the second portions of the blades has a top face coupling with the top face of a corresponding first portion, a pair of opposite lateral faces extending from the pair of opposite lateral faces of the corresponding first portion respectively, and a bottom face connecting with the bottom face of the corresponding first portion.

5. The impeller as claimed in claim 4, wherein the pair of opposite lateral faces of the each of the second portions are concentric with each other and tangential with the pair of opposite lateral faces of the corresponding first portion, respectively.

6. The impeller as claimed in claim 1 wherein the first portions are identical to each other, and two adjacent second portions are different from each other in height.

7. The impeller as claimed in claim 6, wherein the top faces of some of the second portions are spaced from corresponding top faces of the first portions to form steps therebetween.

8. The impeller as claimed in claim 7, wherein the top faces of some of the second portions connect with corresponding top faces of the first portions to form junctions each having a shape like a ridge.

9. The impeller as claimed in claim 8, wherein the top faces of some of the second portions are directly extended from corresponding top faces of the first portions.

10. A fan blade set for a cooling fan, comprising:

a hub comprising a circular wall and an annular wall extending upwardly from a rim of the circular wall; and a plurality of blades extending radially from the annular wall of the hub, each of the blades having a first portion near the hub, and a second portion away from the hub, each of the first portions being identical to an adjacent one of the first portions, and each of the second portions being different from an adjacent one of the second portions regarding heights thereof.

11. The fan blade set as claimed in claim 10, wherein the each of the first portions is substantially planar, and inclinedly attached to the annular wall of the hub.

12. The fan blade set as claimed in claim 10, wherein each of the second portions is bent outwardly from a corresponding first portion to form a curved configuration.

13. The fan blade set as claimed in claim 10, wherein top faces of some of the second portions connect top faces of corresponding first portions via steps, top faces of other second portions directly extend from top faces of other corresponding first portions, and top faces of still other second portions connect top faces of still other corresponding first portions via ridges.

14. The fan blade set as claimed in claim 10, wherein a connection configuration of a top face of the second portion with a top face of the first portion of the each of the blades is different from that of an adjacent blade.

15. An impeller for a cooling fan, the impeller comprising:

a hub having a circular, flat wall, an annular sidewall extending from a rim of the circular, flat wall along a first direction, and a protrusion extending from a center of the circular, flat wall along the first direction, adapted for connecting with a shaft; and a plurality of blades extending radially and outwardly from the annular sidewall, each blade having a first portion extending from the annular sidewall and a curved second portion extending from a free end of the first portion;

wherein the curved second portion has a height different from an adjacent curved second portion.

* * * * *